US009475666B2

(12) United States Patent
Kuchar et al.

(10) Patent No.: US 9,475,666 B2
(45) **Date of Patent: *Oct. 25, 2016**

(54) FULL CONTACT TETER DISPENSION FOR CONTROLLING DEPLOYMENT OF EXPANDABLE WEB MATERIAL

(71) Applicant: KUCHARCO CORPORATION, Metuchen, NJ (US)

(72) Inventors: David M. Kuchar, Metuchen, NJ (US); Matthew J. Kuchar, Metuchen, NJ (US)

(73) Assignee: Kucharco Corporation, Metuchen, NJ (US)

( * ) Notice: Subject to any disclaimer, the term of this patent is extended or adjusted under 35 U.S.C. 154(b) by 254 days.

This patent is subject to a terminal disclaimer.

(21) Appl. No.: 13/998,480

(22) Filed: Nov. 4, 2013

(65) Prior Publication Data

US 2015/0122866 A1 May 7, 2015

(51) Int. Cl.
*B65H 75/18* (2006.01)
*B65H 23/06* (2006.01)
*B65H 20/06* (2006.01)

(52) U.S. Cl.
CPC ..... *B65H 23/06* (2013.01); *B65H 20/06* (2013.01); *B65H 2301/4132* (2013.01); *B65H 2404/223* (2013.01)

(58) Field of Classification Search
CPC ..... B65H 23/022; B65H 16/005; B65H 2301/41369; B31D 5/0056; B31D 5/0065; B31D 2205/0023
USPC ..... 242/597, 597.7, 597.8, 580, 580.1, 579, 242/585, 390, 390.2, 390.3, 390.4
See application file for complete search history.

(56) References Cited

U.S. PATENT DOCUMENTS

| | | | | |
|---|---|---|---|---|
| 1,548,789 | A | 8/1925 | Lorenz | 162/282 |
| 1,550,084 | A | 8/1925 | Lorenz | 162/282 |
| 4,750,896 | A | 6/1988 | Komaransky et al. | 493/357 |
| 4,859,169 | A | 8/1989 | Walton et al. | 425/336 |
| 5,203,761 | A | 4/1993 | Reichental et al. | 493/346 |
| 5,538,778 | A | 7/1996 | Hurwitz et al. | 428/136 |
| 5,667,871 | A | 9/1997 | Goodrich et al. | 428/136 |
| 5,755,656 | A * | 5/1998 | Beierlorzer | B31D 5/0047 493/464 |
| 6,019,715 | A * | 2/2000 | Ratzel | B31D 5/0047 493/464 |
| 6,179,765 | B1 | 1/2001 | Toth | 493/360 |
| 6,200,251 | B1 | 3/2001 | Harding et al. | 493/464 |
| 6,277,459 | B1 | 8/2001 | Lencoski et al. | 428/43 |
| 6,468,197 | B1 * | 10/2002 | Lencoski | B31D 5/0047 493/357 |
| 6,673,001 | B2 | 1/2004 | Toth | 493/365 |

(Continued)

*Primary Examiner* — William A Rivera
(74) *Attorney, Agent, or Firm* — Ernest D. Buff; Margaret A. LaCroix; Ernest D. Buff & Associates, LLC

(57) ABSTRACT

An automatic traction control system expands and deploys compact tightly wound precut paper with die cut slits. The system has an axle with a smaller diameter than the diameter of a tube over which a precut paper package is wound, providing friction free rotation. The precut paper roll rests against a spongy device at one end. The other end rubs against an adjustable cylinder assembly, providing friction that prevents paper spill and misalignment. The axle of the paper handling mechanism is set at an angle to the grab direction of an edge of the precut paper, expanding the grabbed edge and the ungrabbed edge. Grabbing is effected by a belt and two rollers applying precise controlled vertical loading obtained by a slidable and rotatable plate having the weight of a motor, gearbox and pulleys. Due to the angle set, the precut paper stretches expanding the precut paper to three dimensional shape.

17 Claims, 6 Drawing Sheets

(56) References Cited

U.S. PATENT DOCUMENTS

| | | | | |
|---|---|---|---|---|
| 6,910,997 | B1 * | 6/2005 | Yampolsky | B26F 1/22 493/350 |
| 6,989,075 | B1 | 1/2006 | Kao et al. | 162/125 |
| 7,479,100 | B2 | 1/2009 | Toth | 493/464 |
| 8,613,993 | B2 * | 12/2013 | Kuchar | D04D 9/00 229/87.01 |
| 8,919,689 | B2 * | 12/2014 | Kuchar | B65H 23/022 242/580.1 |
| 8,926,305 | B2 * | 1/2015 | Kuchar | B31D 3/002 242/580.1 |
| 2003/0073558 | A1 * | 4/2003 | Chesterson | B31D 5/0052 493/250 |
| 2009/0258775 | A1 * | 10/2009 | Chan | B31D 5/0047 493/464 |
| 2011/0195831 | A1 | 8/2011 | Cheich et al. | 493/464 |
| 2011/0230326 | A1 | 9/2011 | Kung et al. | 493/464 |
| 2013/0237398 | A1 | 9/2013 | Lintala et al. | 493/464 |
| 2013/0240657 | A1 | 9/2013 | Kuchar et al. | 242/418 |

* cited by examiner

Fig. 3
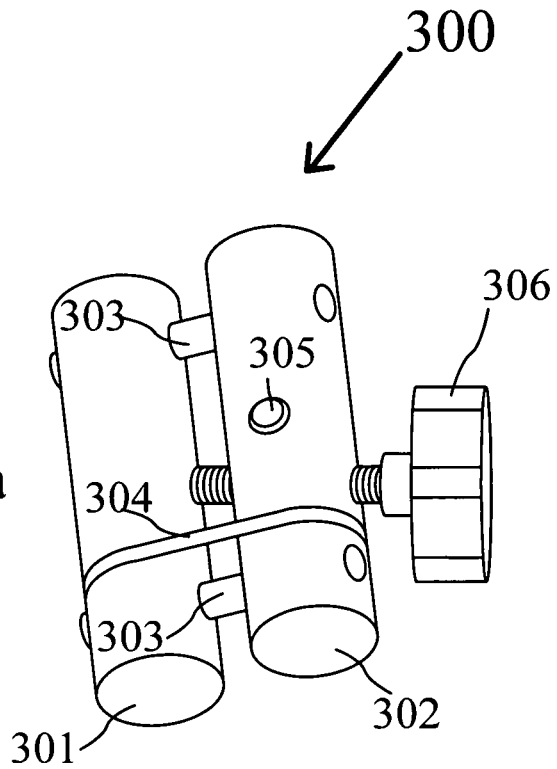
Fig. 3a
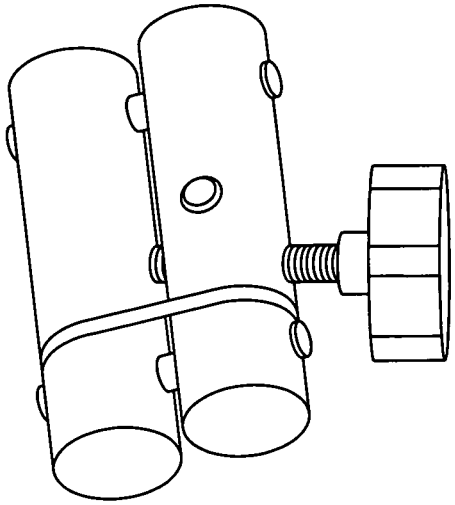
Fig. 3b

FULL CONTACT TETER DISPENSION FOR CONTROLLING DEPLOYMENT OF EXPANDABLE WEB MATERIAL

This application is a continuation-in-part of U.S. application Ser. No. 13/223,316 filed Sep. 1, 2011 entitled "GENERAL PURPOSE DISPENSER TO DEPLOY AND EXPAND WEB MATERIAL" which, in turn, is a continuation-in-part of U.S. application Ser. No. 13/112,106, filed May 20, 2011 which, in turn, is a continuation-in-part of U.S. application Ser. No. 12/943,822, filed Nov. 10, 2010, now abandoned, the disclosures of which are hereby incorporated in their entirety by reference thereto.

BACKGROUND OF THE INVENTION

1. Field of the Invention

The present invention relates to manufacture of package filler material; and, more particularly, to an automatic traction control system for expanding and deploying compact tightly wound paper with die cut slits suited for expansion and deployment of packaging material that cushions articles in a shipping package.

2. Description of the Prior Art

Numerous prior art patents and disclosures relate to delivering paper from cylindrical packages and cutting the papers into sheets of specific sizes. Generally the paper sheet has no slits provided therein and are merely crinkled to create a packaging filler material that is used to surround delicate objects in a packaging. In some patents the paper rolls may have cut slits and the paper with cut slits is expanded to form a packaging material. Paper is not delivered automatically from the cylindrical paper package and is immediately used in small selected sizes to wrap packages. Patents which use crinkling or crumbling to create a package are disclosed in the following U.S. Pat. Nos. 1,548,789 and 1,550,084 to Lorenz; U.S. Pat. No. 4,859,169 to Walton, et al.; U.S. Pat. No. 4,750,896 to Komaransky et al.; U.S. Pat. No. 5,203,761 to Reichental et al.; U.S. Pat. No. 6,179,765 to Toth; U.S. Pat. No. 6,200,251 to Harding et al.; U.S. Pat. No. 6,277,459 to Lencoski et al.; U.S. Pat. No. 6,673,001 to Toth and U.S. Pat. No. 7,479,100 to Toth. These documents do not disclose use of precut paper rolls. Similarly US published patent applications number 20110195831 to Cheich et al.; 20110230326 to Kung et al.; and 20130237398 to Lintala et al. disclose devices that create crumpled or folded packaging pads.

U.S. Pat. No. 5,538,778 to Hurwitz et al. discloses method and apparatus for producing individual rolls of packing material. The paper roll with slits is expanded using a separate machine that has two cylinders rotating at different speeds, and this expansion produces a cylinder with interlocking features. This machine does not deliver expanded sheets of paper with a three dimensional structure from a paper roll having precut slits according to the packaging length needs of the user.

U.S. Pat. No. 5,667,871 to Goodrich, et al. discloses slit sheet packing material. A filling material for use in filling hollow spaces in packaging or the like comprises one or more pieces of flexible paper material. The paper material has a plurality of individual slits formed in parallel spaced rows extending transversely from one end of the paper material to the opposing end of the paper material. The slits in adjacent alternate rows are positioned adjacent the interval space between adjacent slits in the adjacent parallel row of slits. The flexible paper material is expanded by extending the opposing ends of the paper material, which are parallel to the rows of slits. The slits form an array of openings, each opening being generally hexagonal in shape and of the same size. The length and width of the flexible filling paper material can be varied. The construction of the flexible paper filling material permits it to be easily stored in the non-expandable position and easily expanded for use when filling hollow spaces in packaging. As shown in FIG. 2 of the Goodrich, et al. patent, precut sheets are stacked and expanded prior to use in a packaging application. The sheets are not delivered from a continuous roll. Pulling of a sheet forms the expanded configuration, tearing the sheet according to desired lengths of the user.

U.S. Pat. No. 6,989,075 to Kao, et al. et al. discloses a tension activatable substrate that is a dual intensive property tissue. The tissue has a first set of intensive properties including density, surface area, thickness and void volume as presented to the consumer. The consumer plastically activates the tissue by pulling it in tension. A series of slits 44 or other lines of weakness elongate in a direction parallel to the line of tension, allowing the tissue to achieve a second state of intensive properties. The value of the second state of intensive properties is different after activation. The change in value of the intensive properties allows for economies in shipping, where a higher density product is shipped to the consumer. At the point of use, the consumer activates the product to achieve the increase surface area and lower density. Activation is triggered by applying tension to the flat sheet, which is presented in the first state. The activated expanded second sheet is not presented to the customer in a condition that is ready for packaging.

U.S. Patent Application Publication No 20130240657 to Kuchar et al. (hereinafter, "the '657 patent application publication") discloses apparatus to deploy and expand web material. This dispenser deploys and expands cut web material uniformly to form a three dimensional lattice. The unexpanded web material is substantially longer than it is wide. The web material is die cut and has essentially parallel longitudinal strands on opposite transverse sides. The dispenser tracks the threaded web material over three rollers, and uses an adjustable braking mechanism that creates diagonal web tension to pull the paper from the roll. After the web material is threaded through the mechanism, simply pulling the web material on the opposite side from the rollers deploys and expands it simultaneously. The unit can accommodate a plurality of rolls of web material mounted to deploy and expand either individually or simultaneously. The web material itself may have more than one layer. An exemplary embodiment of the dispenser is a motorized version, where a motorized guide wheel assembly pulls the web material, thereby eliminating the necessity of manual deployment. The web material of paper with slits is inserted on bar 6 and pulled through the machine and drawn through the motorized drive. Since the distance between left side roller and the right side roller is the same as that of the paper width inserted in the bar at 5, limiting lateral expansion of the paper.

Based on the foregoing, there exists a need in the art for an automatic compact machine that readily accepts one or more rolls of paper with pre cut slit shapes adapted to expand and create a three dimensional packaging product. It would be particularly desirable if the machine is equipped with means for gently delivering the paper with slits without undue stretching of the paper. It would also be desirable if the paper was designed to expand to the three dimensional shape at the same time that the automatic features of the machine pull out the precut paper. Such a machine would be highly advantageous in that tearing the expanded paper product at desired lengths would efficiently and reliably produce a filler material that facilitated packaging of delicate articles during shipping.

SUMMARY OF THE INVENTION

The present invention provides a compact machine that readily accepts one or more rolls of paper with pre cut slit shapes adapted to be expanded to create a three dimensional packaging product. The machine is equipped with means for gently delivering the paper with slits without undue stretching of the paper. The paper from one or more precut paper rolls is delivered to a paper handling mechanism that includes an automatic drive comprising a motor driven support belt that contacts two rolls. The automatic drive motor is activated by an adjustable speed footswitch. Paper is grabbed at one edge by the support belt/rollers of the paper handling mechanism, driving the paper at a selected speed according to the position of a speed control device turned on and off by a footswitch. Precut paper is thereby delivered according to the needs of the user. The paper expands to the three dimensional shape as it is delivered from the paper handling mechanism. Expansion occurs as a result of the inclination of the axes of the precut paper roll and the delivery direction of the precut paper, which is controlled by the drive mechanism. The angle between the axes of the precut paper roll and the paper delivery direction is typically in the range of 95° to 130°. Due to this angle, which is greater than 90°, the paper is not fed straight through; instead the edge of the precut paper that is distal from the grabbing edge stretches more, since this edge has to travel a longer distance as compared to the grabbed edge. This stretching action expands the precut paper. The user tears the paper when a required distance is attained, or partially expanded precut paper is delivered. This pulling action expands the entire width of the paper. The precut paper rolls of multiple paper rolls can have their axes parallel or inclined to each other; if inclined, the three dimensional shape developed upon expansion is slightly different for each precut paper that forms a three dimensional spongy packaging material. When more than one precut paper roll is passed through the paper handling mechanism, each sheet of precut paper expands, causing the plural precut papers to form a spongy three dimensional packaging material.

The precut paper roll is very sensitive to any deformation due to the presence of plurality of cuts therein, and therefore generally results in unpredictable stretches and shapes of the precut paper when handled in machinery, thereby creating a mess. It is therefore essential that the precut paper be delivered from the precut paper roll to the paper handling mechanism with minimal stretches. This, in turn, requires that the paper roll be essentially floating. It also requires that the precut paper handling structures pull the paper in a uniform manner. At least one continuous precut paper sheet in the form of a roll is generally wound on a paper or polymeric tube similar to a toilet paper roll, and is inserted into an axle provided on the machine. The axle has a diameter smaller than that of the tube aperture, so that the precut paper roll is free to rotate with minimal friction. However, the precut paper may be drawn at off angles, and proper drawing of the precut paper requires that the free precut paper roll be prevented from tilting. In addition, reduced friction between the tube inner surface and the axle outer surface will cause the precut paper to spill, which is also highly undesirable. The design features of the precut paper delivery mechanism prevent each of these problems. The first feature includes a springy device against which the precut paper roll rests. The springy device comprises two sheets of high molecular weight polyethylene with a polyurethane foam placed there between. This spongy spring action prevents any angular misalignment of the precut paper roll and restores proper alignment of precut paper due to higher spring action where the polyurethane foam is excessively compressed. The other end of the precut paper roll distant from the spongy device rests against a friction-generating cylinder pegged in a hole in the axle and is capable or rotation in a plane parallel to the axes. The location of the friction generating cylinder is adjustable by the user using a screw, which may be turned to bear the outer surface of the polymeric cylinder against the edge of the precut paper roll. The friction generating assembly, in one embodiment, comprises a fixed cylinder and a movable cylinder that is attached to the fixed cylinder by a screw. The assembly is pegged through a hole provided in the axle. The movable cylinder may be advanced by the screw to create a higher level of rub between the movable cylinder and the outer surface of the precut paper roll, creating a higher level of friction. If the screw is turned backwards, the movable cylinder is withdrawn, assisted by an O-ring retainer; this reduces the level of friction applied to the precut paper roll. This adjustment prevents the spillage of paper as the precut paper is drawn from the precut paper roll. This arrangement, in combination with the spongy device, essentially floats the precut paper roll, preventing paper spill or off angular feed of precut paper. Application of excessive stresses to the precut paper is thus avoided, preventing expansion of the precut paper during delivery within the machine.

The second key aspect of the invention is that the paper handling mechanism does not apply excessive stresses to the precut paper that is being drawn automatically by the motor action. This is in contrast to the device disclosed in US published patent application 20110309125 (patent application Ser. No. 13/223,316 filed Sep. 1, 2011), which drives the paper between hard non compliant rollers, one large in diameter and two smaller in diameter. The contact between the three hard rollers is indeterminate and unreliable and therefore the delivery of the precut paper is not uniform or reliable. This problem is overcome by the automatic traction control system described herein, which drives the precut papers between a precisely loaded compliant belt and two rollers. The automatic traction control system of the present invention uses a precut paper loading assembly in the form of a slidable plate that has a DC motor with 90 degree worm gear box connected to a pulley. A foot switch controls the motor speed. Pressing the footswitch to a larger extent increases motor speed. Two pulleys are also mounted on the slidable plate in nearly horizontal orientation. A polyurethane V belt connects the three pulleys. The loading assembly plate is slidable on a fixed pin that slides and allows rotation and vertical rise with respect to a stationary plate affixed to the base of the unit. The stationary plate has clearance holes or pre-shaped slots. Connecting bolts between movable plates allow those plates to move freely within the clearance holes or pre-shaped slots in the stationary plate. With this arrangement, the moveable plates move freely within prescribed boundaries and generally downwards to their original position due to gravity caused by the weight of the motor, gearbox and attachments. The outer surface of the polyurethane V belt contacts two rollers mounted on the base of the paper handling mechanism providing predictable loading, which is the combination of the weight of loading assembly and spring minus friction. A small spring is provided that provides uniform loading of the belt on the rolls that contact the belt during rotation of the loading assembly plate. Since the polyurethane belt is an elastomeric material it conforms to irregularities of the two rollers, always providing predicable constant pressure at the interface between the belt and the rollers. Consequently, there is minimal slip between the belt and surface of the two rollers when precut paper is driven through the paper handling mechanism. When one or more continuous precut paper sheets is driven through this contact region by the motor drive, the paper is driven with uniform predictable loading regardless of the motor speed set, preventing application of undue stress to the precut paper sheet. Due to the angle provided between the axes of the precut paper roll and the paper handling mechanism, the edge of the paper that is grabbed progresses with some stretch while the edge of the precut paper distal from the grabbed edge stretches more. The additional stretching is due to the larger distance of paper movement, which expands the precut paper into three dimensional shapes. When an adequate length of partially expanded precut paper is automatically delivered by the paper handling mechanism, the user releases the foot switch and tears the paper. This tearing action further advances expansion of the entire width of the precut paper web. Thus, the expanded three dimensional shapes everywhere are prevalent throughout the now fully expanded web.

Significant advantages are realized by practice of the present invention. In its preferred embodiment, the system for automatic traction control for expansion and deployment of a compact tightly wound package of paper with die cut slits comprises:

i) one or more compact tightly wound continuous precut paper sheets, axially wound to form a tubular interior or wound on a tube to form a tubular interior;

ii) said tube or tubular interior having a larger diameter aperture as compared to the axle diameter of the traction control associated with the expansion machine over which the tightly wound precut roll package is inserted. This arrangement facilitates floating the package with minimal friction or misalignment from side to side;

iii) said precut paper roll resting against a spongy device on the axle, preventing angular misorientation of the precut paper roll;

iv) said spongy device comprising a pair of polymeric sheets with a sponge inserted therebetween;

v) the distal end of a precut roll rubbing against an adjustable cylinder assembly, thereby generating friction that prevents spill of precut paper while maintaining central alignment and uniform precut paper feed due to pressure of the precut paper roll against the spongy device;

vi) a paper handling mechanism has a precut paper loading assembly in the form of a slidable and rotatable plate held by a pin secured to a fixed plate attached to the base of the device, the slidable plate carrying a speed controllable DC motor with 90 degree worm gear box connected to a pulley that has a polyurethane V belt connecting two pulleys also mounted on the slidable plate said belt contacting two rollers mounted on the base of the paper handling mechanism wherein one edge of a precut paper may be passed between the top of the two rollers and the outer surface of the polyurethane belt grabbing the precut paper by the edge, the load applied to the precut paper is predictably controlled due to the weight of the motor and pulleys present on the slidable plate;

vii) said axle of the precut paper roll being inclined at an angle greater than 90 degrees to the direction of pull for the paper handling mechanism, so that the precut paper at the grabbed edge is taut, while kept having less stretch while the distal end of the precut paper is stretched more to accommodate the larger distance present, thereby expanding the precut paper to create a three dimensional structure when the user activates the footswitch;

viii) when a required length of precut expanded paper is delivered the user releases the footswitch which stops the paper handling machinery securely retaining the paper, whereupon the user tears the paper, which expands the entire width of the paper;

ix) when multiple plies of precut paper are inserted through the paper handling mechanism, the three dimensional shapes tangle together or stitch forming a spongy packaging material;

whereby the precut paper roll floats and the paper handling mechanism aligns the paper centrally, preventing undue expansion of precut paper while gripping the paper when automatically pulled by the automatic traction control mechanism to create a three dimensional web expansion especially suited for packaging paper, and gripping action during a hard tearing pull on said expanded web of paper packaging material secures the unexpanded edge of precut paper, eliminating the need for rethreading the paper handling mechanism.

In another aspect of the invention, a more advanced drag or braking for the web can be accomplished by attaching the spongy device's rear plate to a motorized linear actuator's rod. The attachment is effected by a perpendicular connection located centrally to the centered most point of the spongy device's rear plate. This arrangement facilitates movement of the spongy device in a linear direction in the amount of 0" to ½". The actuator is used for compressing or decompressing the spongy device. The spongy device, as connected to the actuator, is controlled incrementally by using sensor signals to a computing device or logic control. Typically, control of the actuator is enabled using a web tension sensor of the transducer type, or the like measuring slack in the web. A proximity sensor (ultra sonic type) or the like typically measures the diameter of a roll such as the pre-slit paper package. Sensors can be used independently or more than one at a time to control the actuator. Therefore signals from one or more sensors are used to control the actuator' rod, which is connected to said spongy device to accommodate compression or decompression of the spongy device. The actuator rod is moved to and fro, incrementally using signal inputs from sensors to a Programmable Logic Control (PLC) or Programmed Logic Chip, or the like, or a computer. These programmable computing devices can be used with or without a feedback loop and typically have a reset feature, or can be programmed to accomplish the correct web tension and control. In this manner, the spongy device is decompressed as the roll is continuously off-wound, thereby controlling drag or braking of the web. The linear actuator is mounted to the vertical column behind the spongy device with its rod passing through the vertical column and is attached to the back of the spongy device.

BRIEF DESCRIPTION OF THE DRAWINGS

The invention will be more fully understood and further advantages will become apparent when reference is had to the following detailed description of the preferred embodiments of the invention and the accompanying drawing, in which:

FIG. 3*a* is a perspective view of a friction generating device, showing a pair of polymetric cylinders in a first position;

FIG. 3*b* is a perspective view of a friction generating device, showing a pair of polymetric cylinders in a second position;

DETAILED DESCRIPTION OF THE INVENTION

Figure 1:
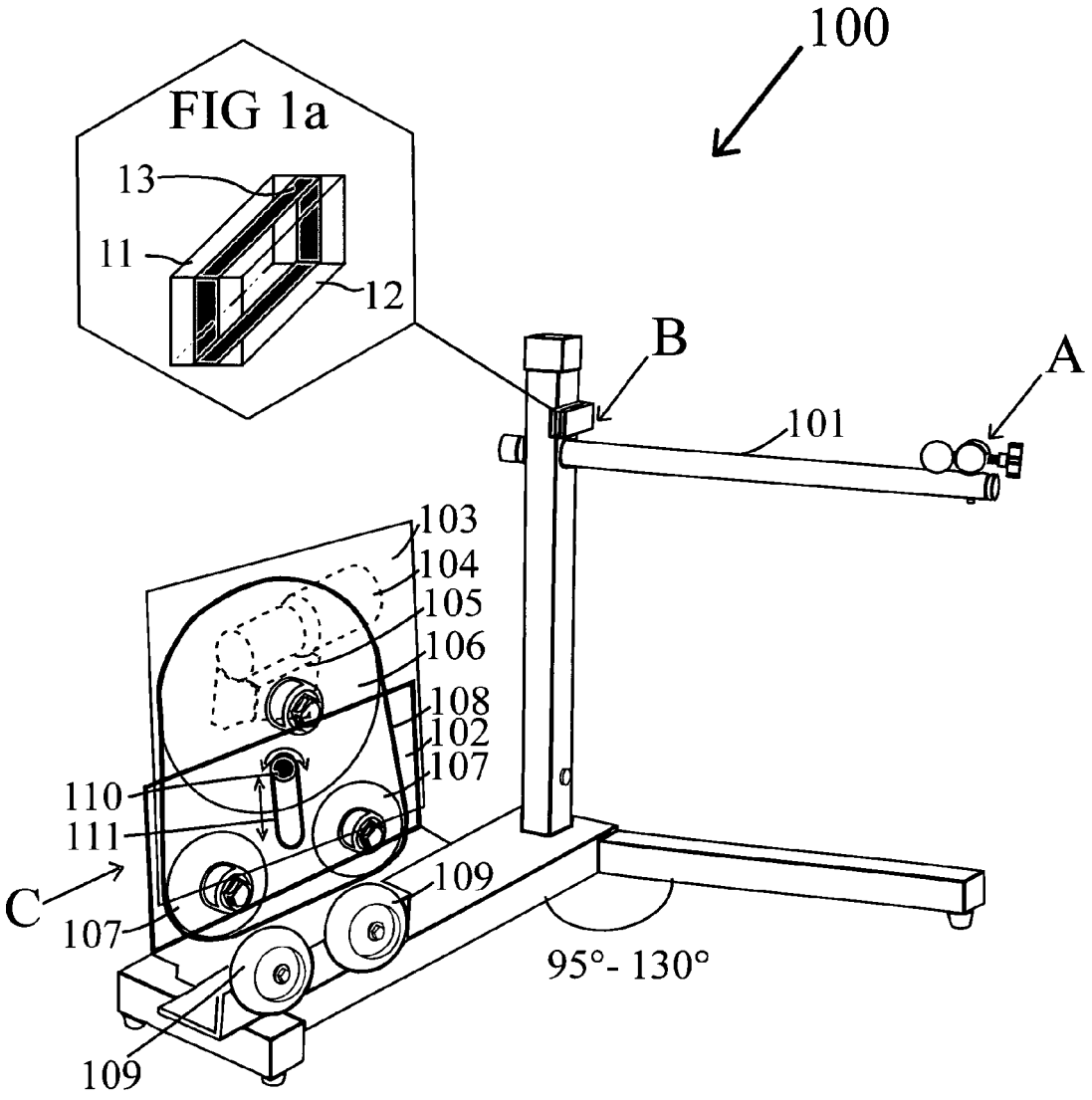
FIG. 1 is a schematic arrangement of the automatic traction control system for expansion and deployment of a compact tightly wound package of paper with die cut slits.

This invention relates to a traction control system for expansion and deployment of a compact tightly wound package of paper with die cut slits. A paper roll has die cut slits suited for expansion. Preferably, the die cut slits are in the form of tilde shapes that are offset from each other as detailed in the published US patent application 2010/0196633. The paper with these precut slits expands very easily and any application of stresses to the paper in any direction causes severe deformation of the paper. Any machine that delivers the precut paper to a user must drive the paper with minimal stresses applied; and this is a difficult task.

The present invention deals with several aspects of stress generation when driving the precut paper from a compact tightly wound roll. The compact precut paper roll is wound on a central tube and is slipped on an axle of the machine of the present invention. Since the diameter of the axle is smaller than that of the tube of the precut paper roll, the latter rolls with minimal friction, but is subject to angular misalignment. The axle has a spongy device against which the compact precut paper roll rests. The spongy device is made from two polymeric sheets separated by a sponge. The polymeric sheets may be ultra high molecular weight polyethylene or any other suitable plastic material or metallic material. The sponge may be a polyurethane foam or other springy material such as a helical spring. This spongy device prevents angular misalignment of the compact precut roll since the spongy device pushes against the misoriented direction bringing the compact precut paper roll into proper alignment. The other end of the compact precut paper roll rests against a position adjustable cylinder assembly pegged to an aperture in the axle so that the assembly is free to rotate. The cylinder is adjusted to rub against the periphery of the compact paper roll or an end cap associated with the tubular interior of the roll. With this arrangement, there is generated sufficient friction to prevent spillage of precut paper from the floating compact paper roll. In addition, the compact paper roll is pressed against the spongy device at all times by the force applied by the rubbing cylinder; this maintains uniform flow of precut paper through the machine of the present invention.

The precut paper is automatically pulled from the compact precut paper roll and fed into the paper handling mechanism. The paper handling mechanism includes a slidable and rotatable plate held by a pin secured to a fixed plate attached to the base of the device, the slidable plate carrying a speed controllable DC motor geared down by a 90 degree gear box connected to the pulley. The slidable plate also carries two pulleys whose axes are in the horizontal plane. A polyurethane V belt connects these three pulleys. The outer surface of the polyurethane V belt contacts the upper surface of two rollers mounted on the base of the paper handling mechanism. The loading of the polyurethane belt is very well controlled and predictable and is equal to what is on the slidable plate, namely, the weight of DC motor, gear box, pulleys provided minus any friction. One edge of the precut paper is passed through the space between the outer surface of the belt and the two rollers and is therefore loaded with controlled precise loading, and drives the paper when the DC motor is turned on to thereby deliver precut paper with precise selected speed and with minimal stretching of precut paper. Since the axle of the precut paper roll is inclined at an angle in the range of greater than 90 degrees to 130 degrees with respect to the direction of draw of the paper handling mechanism at the grabbed edge of the precut paper, the precut paper is taut and also expands at its grabbed edge. However, the edge distal from the grabbed edge is stretched more due to the longer distance that the paper must travel diagonally, thus expanding to develop a three dimensional structure. When an adequate length of precut paper is delivered, the user releases the foot switch stopping the motor, at which point the paper handling mechanism securely holds the paper. When the user pulls to tear the paper, the added stress applied allows expansion for the entire width of the precut paper, developing a three dimensional structure within the entire width of the paper that is deployed.

FIG. 1 is a schematic arrangement of the automatic traction control system for expansion and deployment of a compact tightly wound package of paper with die cut slits. The system, shown generally at 100, has an axle 101 designed to receive a compact precut paper roll package, which is in the unexpanded state. The compact precut paper roll is designed to rest and push against the spongy device B, shown in detail in FIG. 1*a*. The sponge device comprises hard plastic sheets 11 and 12 with a sponge 13 interposed therebetween. The plastic sheets may be made from ultra high molecular weight polyethylene or other plastics and the sponge is a polyurethane sponge or other springs. This sponge device prevents misalignment of the compact precut paper roll. The other end of the paper roll rubs against the friction-generating cylinder A, as shown in detail by FIGS. 3A and 3B. The paper handling mechanism C comprises a fixed plate 102 mounted to the base of the unit and has a slidable plate 103 using a pin 110 which is fixed to plate 102 and allows plate 103 to slide up or down in the slot 111 provided in the movable plate 103. The slidable plate may also rotate on the pin 110. The slidable plate carries a DC motor 104 controlled by a speed controller and a foot switch (not shown) and a 90 degree reduction gear box 105 preferably of the worm and gear type. The shaft of the gearbox passes through the slidable plate and carries a pulley 106. Two additional pulleys 107 are mounted on the same slidable plate 103 and a polyurethane V belt 108 connects these three pulleys. The outer surface of the polyurethane belt, which is nearly horizontal contacts the upper surfaces of two rollers 109 mounted on the base of the machine. The precut paper from the precut paper roll is inserted between the outer surface of the polyurethane V belt and the two rolls 109. The loading of the inserted paper is essentially the weight of the slidable plate and said attachments minus friction. Since the slidable plate is rotatable about the pin 110, equal loading of the belt 108 on the two rollers 109 is assisted by a spring, not shown in this diagram. As noted in this diagram, the angle between the axes of the precut roll and the drawing direction of the paper handling mechanism C is in the range of 95 to 130 degrees. FIG. 1 can only handle a single roll of precut paper.

Figure 2:
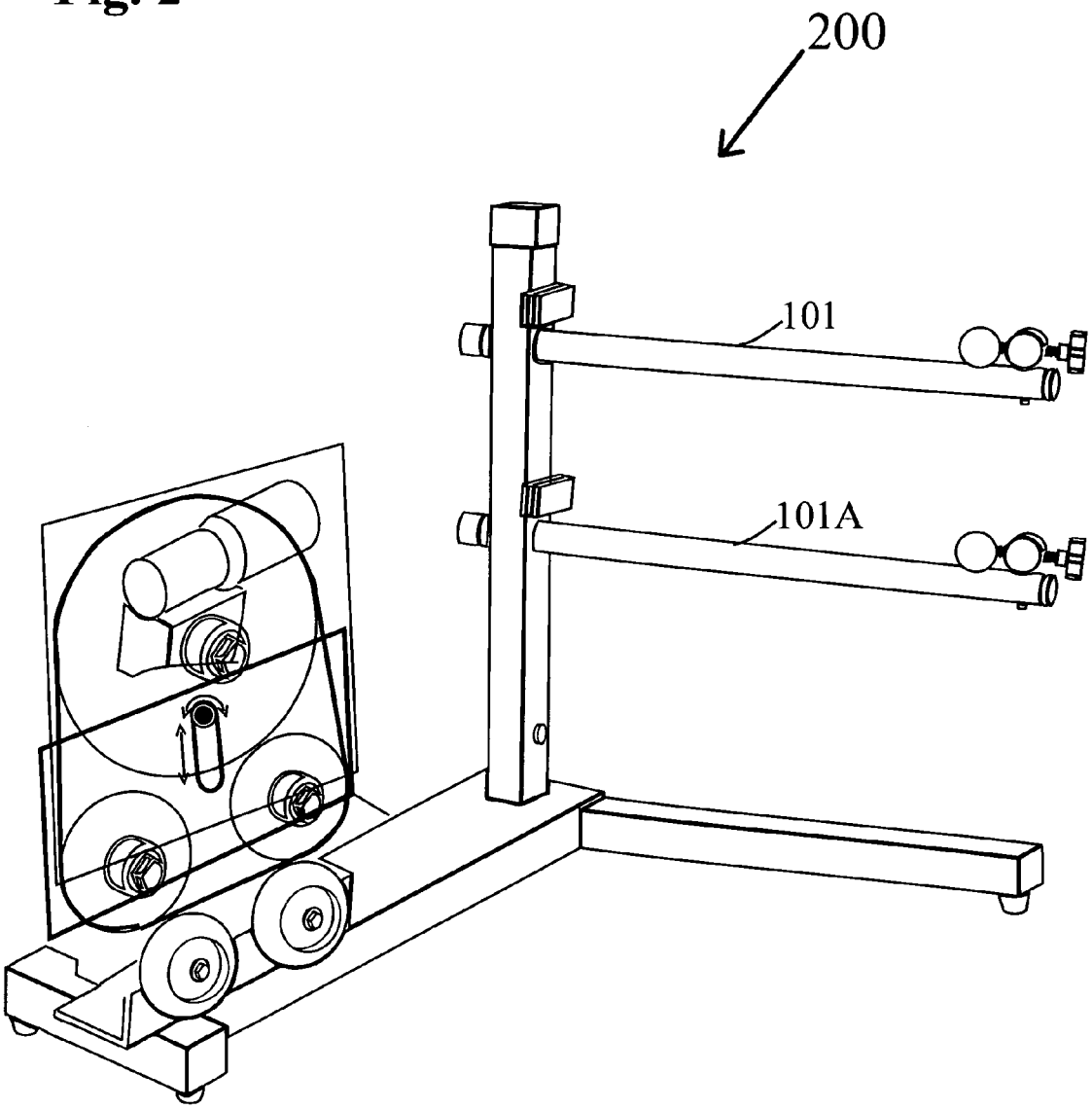
FIG. 2 is a schematic arrangement of the automatic traction control system for expansion and deployment of two rolls of compact tightly wound packages of paper with die cut slits forming tangled three dimensional shapes.

FIG. 2 shows at 200 a schematic arrangement of the automatic traction control system for expansion and deployment of two rolls of compact tightly wound packages of paper with die cut slits forming tangled three dimensional shapes. This figure is identical to FIG. 1 except that there are two axes 101 and 101A to carry two precut paper rolls.

FIG. 3 illustrates the friction generating cylinder 300 in two views, FIG. 3*a* and FIG. 3*b*. Polymeric cylinder 301 contacts the side periphery of the compact precut paper roll, generating friction or drag. The position of 301 is adjusted by turning screw 306, which displaces the movable cylinder 301 with respect to fixed cylinder 302. The latter is pegged to the axle by pin 305 through and aperture in the axle. The O-ring 304 retracts cylinder 301 towards cylinder 302 when the screw is loosened. The two cylinders always remain substantially parallel due to the guides 303.

Figure 4:
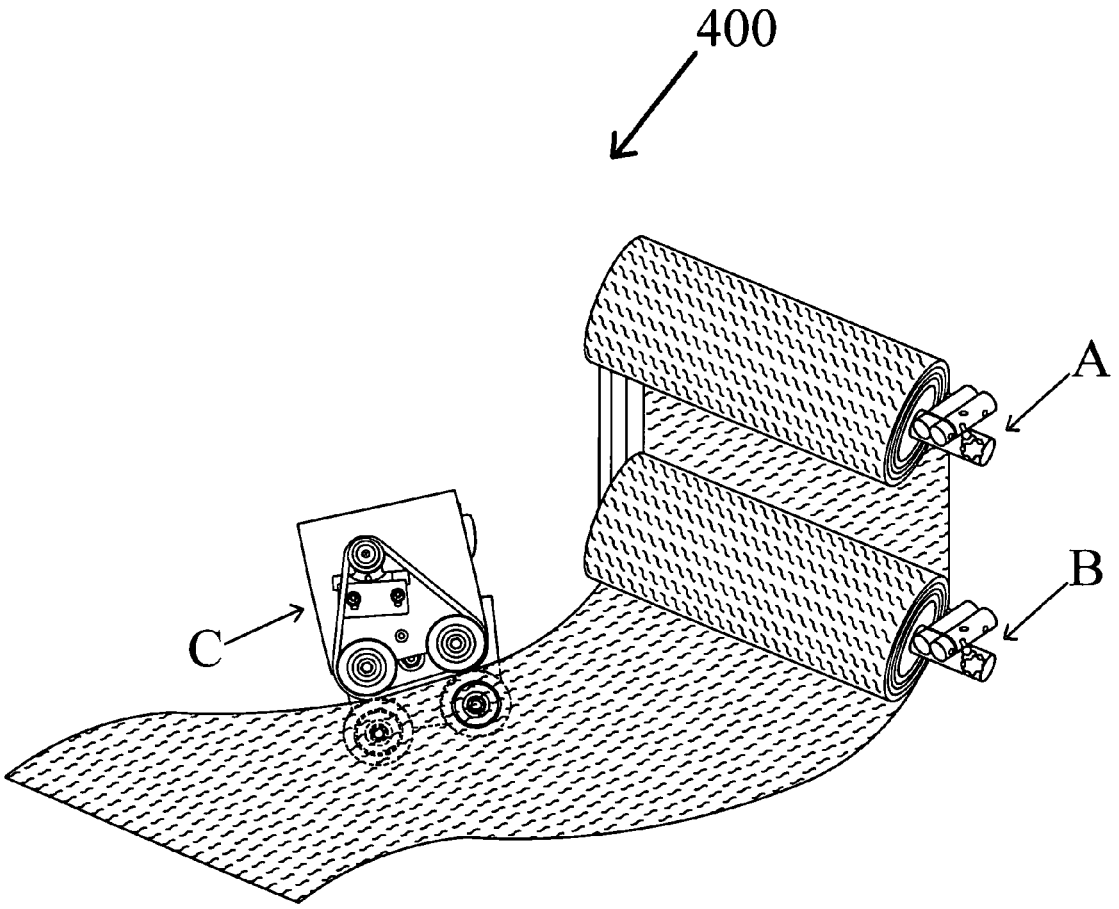
FIG. 4 is a perspective view of the automatic traction control depicting the expansion and deployment of two compact tightly wound packages of paper with die cut slits.

FIG. 4 is a perspective view showing generally at 400 the automatic traction control, and depicting the expansion and deployment two compact tightly wound paper packages of paper with die cut slits. This illustrated schematic drawing has two precut rolls A and B passed through the paper handling mechanism C. As seen in FIG. 4 of the drawings, the left edge of the paper is grabbed and driven by the motor drive of the paper handling mechanism while the end of the precut paper distal from the grabbing end, the right edge, shows expansion of the precut paper developing three dimensional structure.

Figure 5:
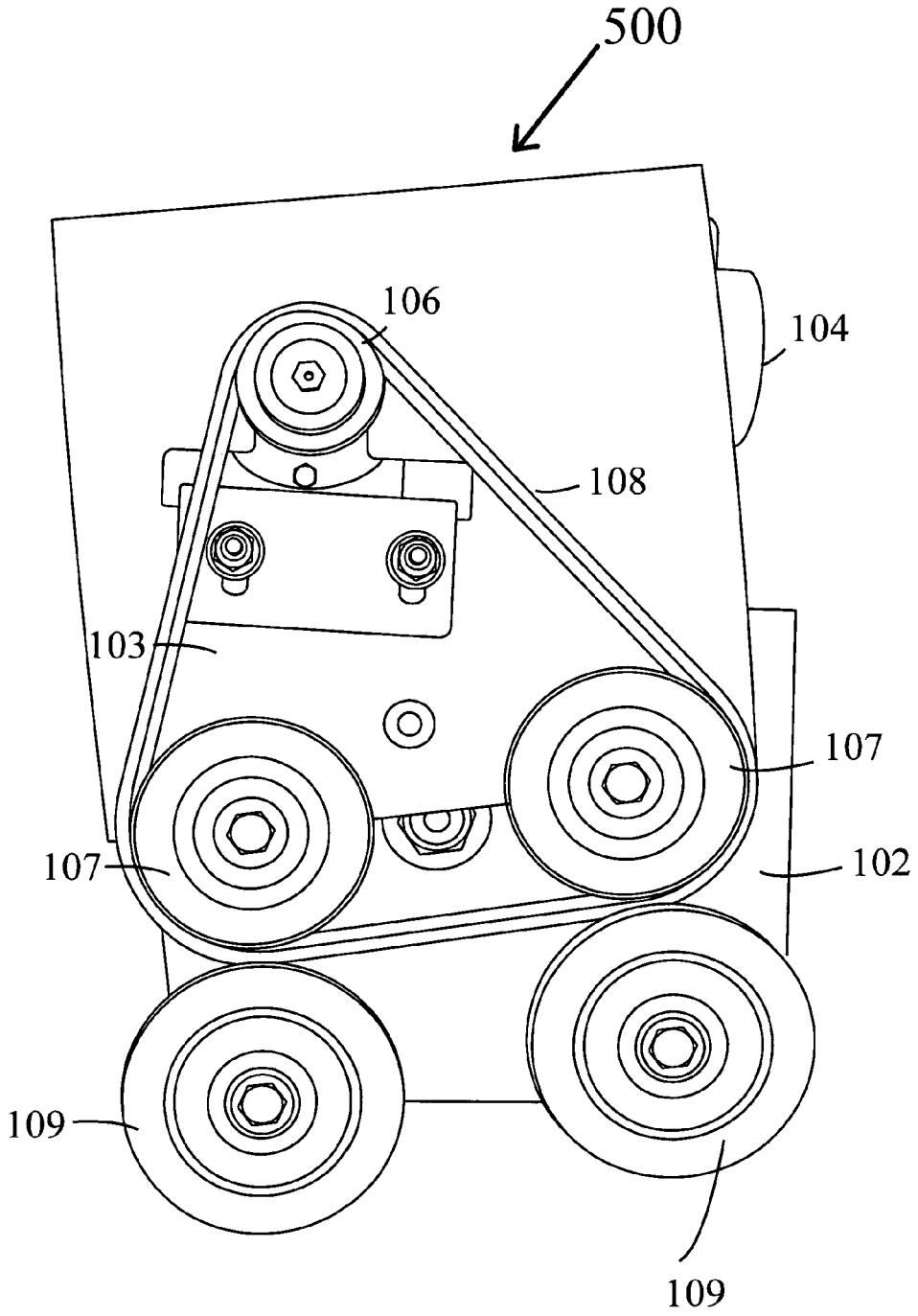
FIG. 5 is a side view illustrating the details of the slidable loading mechanism of the paper handling mechanism.
Figure 6:
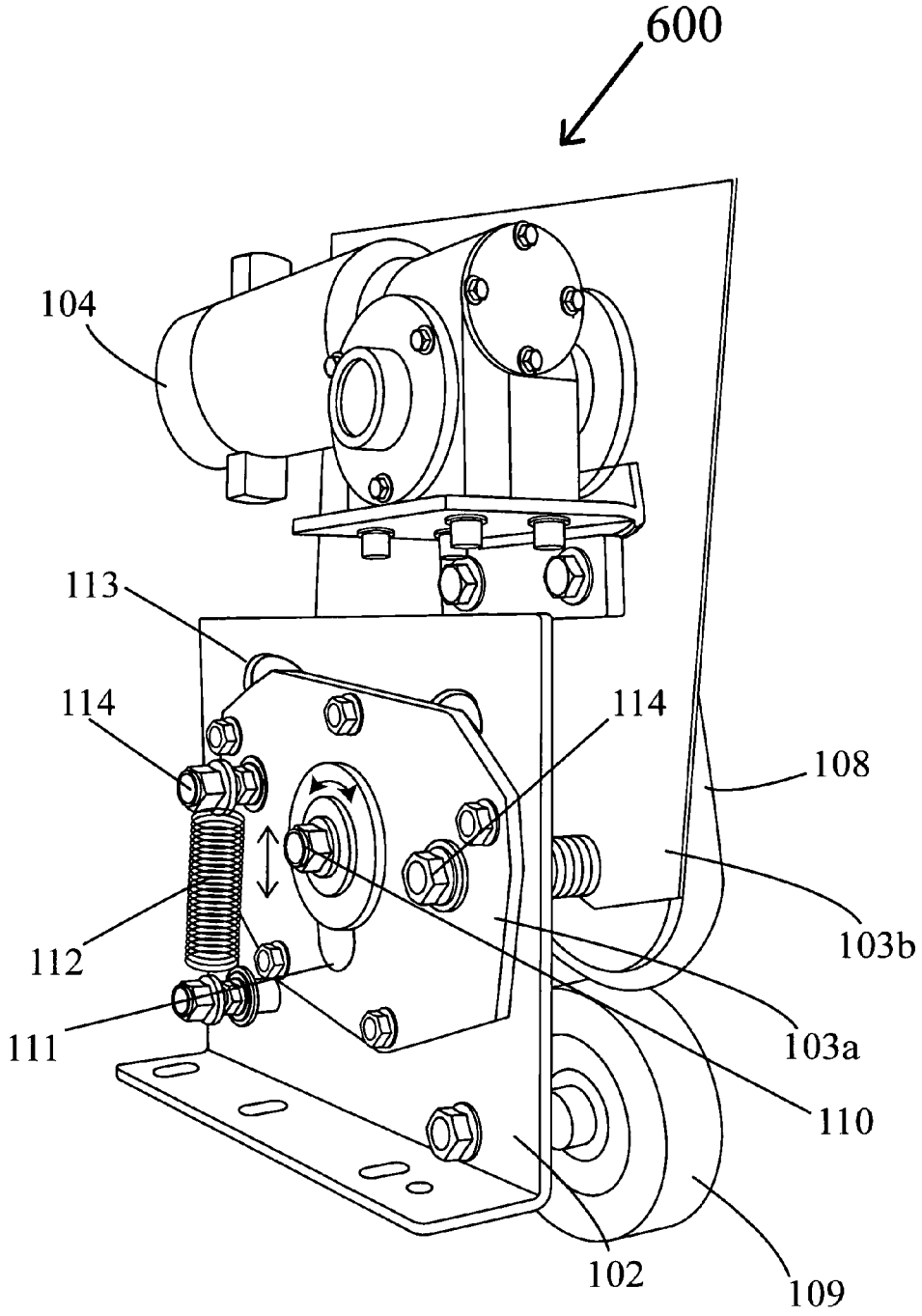
FIG. 6 illustrates the details of the rear side of the slidable loading mechanism of the paper handling mechanism.

FIG. 5 is a side view illustrating at 500 the details of the slidable loading mechanism of the paper handling mechanism. Shown here is the slidable plate 103 that slides up or down as well as rotates about the pin 110 and slot 111, not visible in this view, in combination with movable plate 103*a* of FIG. 6, and is attached to the base of the unit by fixed plate 102, as shown in FIG. 6. The arrows indicate sliding as well as rotation of plate 103*a* and 103*b* at pin 110 of FIG. 6. The slidable plate carries a DC motor 104 controlled by a controller and a foot switch (not shown) and a 90 degree reduction gear box preferably of the worm and gear type. The shaft of the gearbox passes through the slidable plate and carries a pulley 106. Two additional pulleys 107 are mounted on the same slidable plate 103 and a polyurethane V belt 108 connects these three pulleys. The outer surface of the polyurethane belt, which is nearly horizontal, contacts the upper surfaces of two rollers 109 mounted on the base of the machine.

FIG. 6 is a drawing illustrating at 600 the details of the rear side of the slidable loading mechanism of the paper handling mechanism. In this figure, 102 is the fixed plate having over sized clearance bolt holes or slots 113 allowing movable plates 103*a* and 103*b*, with their bolted connections 114 having ample space for movement within said slots, and is attached to the base of the unit. The slidable plates 103*a* and 103*b* are attached to each other by said bolts passing through said clearance holes of plate 102 in FIG. 6 and slide up and down as well as rotate on the pin 110. The sliding action is limited to the slot 111 in the movable plate 103*a* attached to the base plate 102 by the pin 110 and slot 111 in combination, including the connecting bolts between plates 103*a* and 103*b* that pass through the clearance holes in fixed plate 102. The motor is shown at 104. The polyurethane V belt is shown at 108 contacting rollers 109. The arrows indicate sliding as well as rotation at pin 110. The spring that brings the slidable and rotatable plate into proper position for contact between the two rollers and the polyurethane belt is shown at 112. The presence of the spring limits the overall loading at the contacting location between the belt and the two rollers so that a hand could be passed through with minimal or no injury while the paper is still held in contact.

Having thus described the invention in rather full detail, it will be understood that such detail need not be strictly adhered to, but that additional changes and modifications may suggest themselves to one skilled in the art, all falling within the scope of the invention as defined by the subjoined claims.

What is claimed is:

1. An automatic traction control system for expansion and deployment of compact tightly wound precut paper with die cut slits, comprising:

a) one or more compact tightly wound continuous sheets of precut paper disposed on a tube having a tubular interior or being axially wound to form a tubular interior;

b) said tubular interior having a larger diameter aperture as compared to the axle diameter of the traction control over which a tightly wound precut roll package is inserted to float the package with minimal friction or misalignment from side to side;

c) said precut paper roll resting against a spongy device on the axle preventing angular misorientation of the precut paper roll;

d) the distal end of the precut paper roll rubbing against an adjustable cylinder assembly to generate friction that prevents spill of precut paper while maintaining central alignment of paper delivery and uniform precut paper feed due to pressure exerted by said precut paper roll against said spongy device;

e) a paper handling mechanism having a precut paper loading assembly in the form of a slidable and rotatable plate that has an adjustable speed DC motor with a 90 degree worm gear box connected to a pulley that has a polyurethane V belt connecting two pulleys being mounted on the slidable plate, said belt contacting two rollers mounted on the base of the paper handling mechanism, wherein one edge of a precut paper sheet passed between the top of the two rollers, and the outer surface of a compliant polyurethane belt grabbing the precut paper by the edge, the load applied to the precut paper being predictably controlled due to the weight of the motor, pulleys and a spring present on the slidable and rotatable plate;

f) said axes of the precut paper roll being inclined at an angle greater than 90 degrees to the direction of pull of the paper handling mechanism, the precut paper at the grabbed edge being taut and stretched while the distal end of the precut paper is stretched more to accommodate the larger distance present, thereby expanding the precut paper creating three dimensional structure when the user activates the footswitch; and g) when multiple plies of precut paper are inserted through the paper handling mechanism, the three dimensional shapes tangle together or stitch forming a spongy packaging material;

whereby the precut paper roll floats and the paper handling mechanism aligns the paper centrally, preventing undue expansion of precut paper while gripping the paper when automatically pulled by the said paper handling mechanism, thereby creating a three dimensional web expansion especially suited for packaging paper, and gripping action during a hard tearing pull on said expanded web of paper packaging material secures the unexpanded edge of precut paper, eliminating the need for rethreading the paper handling mechanism.

2. The automatic traction control system for expansion and deployment of a compact tightly wound precut paper package with die cut slits as recited by claim 1, wherein the said spongy device comprises a pair of polymeric sheets with a sponge inserted therebetween.

3. The automatic traction control system for expansion and deployment of a compact tightly wound precut paper package with die cut slits as recited by claim 2, wherein said polymeric sheet is high molecular weight polyethylene.

4. The traction control system for expansion and deployment of a compact tightly wound precut paper package with die cut slits as recited by claim 2, wherein said sponge is a polyurethane sponge.

5. The automatic traction control system for expansion and deployment of a compact tightly wound precut paper package with die cut slits as recited by claim 1, wherein said slits are tilde shaped.

6. The automatic traction control system for expansion and deployment of a compact tightly wound precut paper package with die cut slits as recited by claim 1, wherein said adjustable cylinder generating friction comprises a fixed cylinder pegged to a hole in the axle connected to a movable cylinder through a screwed connection.

7. The automatic traction control system for expansion and deployment of a compact tightly wound precut paper package with die cut slits as recited by claim 6, wherein said movable cylinder and fixed cylinder are connected by tracks maintaining a substantially parallel disposition.

8. The automatic traction control system for expansion and deployment of a compact tightly wound precut paper package with die cut slits as recited by claim 1, wherein said slidable and rotatable plate applies predictable loading on the precut paper driven through said paper handling mechanism, said loading being equal to the weight of motor, gear box and pulleys minus friction.

9. The automatic traction control system for expansion and deployment of a compact tightly wound precut paper package with die cut slits as recited by claim 1, wherein said slidable and rotatable plate is attached to a fixed plate having apertures therein and connected to the base of the device by a pin which allows sliding and rotation in slots provided by the fixed and movable plates.

10. The automatic traction control system for expansion and deployment of a compact tightly wound precut paper package with die cut slits as recited by claim 1, wherein said angle between the axes of compact precut paper roll and paper handling mechanism's paper delivery direction is in the range of greater than 90 degrees to 130 degrees.

11. The automatic traction control system for expansion and deployment of a compact tightly wound precut paper package with die cut slits as recited by claim 1, wherein the compliant polyurethane flat belt contacts the two rolls in a horizontal plane.

12. The automatic traction control system for expansion and deployment of a compact tightly wound precut paper package with die cut slits as recited by claim 1, wherein said an adjustable cylinder assembly rubs against an end cap inserted in the tubular interior.

13. The automatic traction control system for expansion and deployment of a compact tightly wound precut paper package with die cut slits as recited by claim 1, said tubular interior being associated with at least one end cap.

14. The automatic traction control system for expansion and deployment of a compact tightly wound precut paper package with die cut slits as recited by claim 1, having at least one end cap so disposed with respect to said tubular interior that said end cap rubs against said adjustable cylinder assembly to generate said friction.

15. The traction control system for expansion and deployment of a compact tightly wound precut paper package with die cut slits as recited by claim 1, further comprising a motorized linear actuator for automatically adjusting sponge decompression to control friction or drag on said precut paper roll during delivery of said precut paper.

16. The traction control system for expansion and deployment of a compact tightly wound precut paper package with die cut slits as recited by claim 15, wherein said motorized linear actuator presets compression on said sponge, which pressure is controllably reduced in accordance with web tension and roll diameter to maintain proper pressure against said sponge as said roll diameter decreases.

17. The traction control system for expansion and deployment of a compact tightly wound precut paper package with die cut slits as recited by claim 15, wherein for any size roll placed on said axle of said traction control, said linear actuator automatically presets compression of said spongy device to thereby maintain constant a correct web tension until said paper package is finally spent.

* * * * *